US009123524B2

(12) United States Patent
Kloss et al.

(10) Patent No.: US 9,123,524 B2
(45) Date of Patent: Sep. 1, 2015

(54) CERAMIC BUSHING FOR A HIGH-PRESSURE DISCHARGE LAMP

(75) Inventors: Andreas Kloss, Neubiberg (DE); Wolfgang Poeppel, Augsburg (DE); Klaus Stockwald, Germering (DE); Steffen Walter, Oberpframmern (DE)

(73) Assignee: OSRAM GmbH, Munich (DE)

( * ) Notice: Subject to any disclaimer, the term of this patent is extended or adjusted under 35 U.S.C. 154(b) by 29 days.

(21) Appl. No.: 13/880,067

(22) PCT Filed: Oct. 19, 2010

(86) PCT No.: PCT/EP2010/065728

§ 371 (c)(1), (2), (4) Date: May 22, 2013

(87) PCT Pub. No.: WO2012/052054

PCT Pub. Date: Apr. 26, 2012

(65) Prior Publication Data

US 2013/0241405 A1 Sep. 19, 2013

(51) Int. Cl.
*H01J 61/36* (2006.01)
*H01J 61/82* (2006.01)

(52) U.S. Cl.
CPC . *H01J 61/36* (2013.01); *H01J 61/82* (2013.01)

(58) Field of Classification Search
CPC ..... H01J 5/46; H01J 5/50; H01J 61/36; H01J 61/366; H01J 9/28
USPC ..... 313/623
See application file for complete search history.

(56) References Cited

U.S. PATENT DOCUMENTS

| | | | | |
|---|---|---|---|---|
| 5,625,256 | A | 4/1997 | Tiedt et al. | |
| 6,232,718 | B1 * | 5/2001 | Johnston et al. | 313/623 |
| 6,528,945 | B2 | 3/2003 | Kelly et al. | |
| 7,132,798 | B2 | 11/2006 | Niimi | |
| 7,843,137 | B2 * | 11/2010 | Watanabe et al. | 313/625 |
| 8,581,493 | B2 * | 11/2013 | Howell et al. | 313/634 |
| 8,786,187 | B2 * | 7/2014 | Buttstaedt et al. | 313/635 |
| 2003/0209984 | A1 | 11/2003 | Niimi | |
| 2009/0021172 | A1 * | 1/2009 | Graser et al. | 313/623 |
| 2009/0160339 | A1 * | 6/2009 | Patrician | 313/625 |
| 2010/0187994 | A1 | 7/2010 | Braun et al. | |
| 2011/0248028 | A1 | 10/2011 | Huettinger et al. | |
| 2014/0028183 | A1 * | 1/2014 | Hartmann et al. | 313/608 |

FOREIGN PATENT DOCUMENTS

| | | | |
|---|---|---|---|
| CN | 1457081 | A | 11/2003 |
| DE | 202007013119 | U1 | 11/2008 |

(Continued)

OTHER PUBLICATIONS

Machine English translation of DE102007055399 to Goihl.*

(Continued)

*Primary Examiner* — Sikha Roy

(57) ABSTRACT

A bushing for a high-pressure discharge lamp, which is suitable for connecting an electrode in the interior of a ceramic discharge vessel to a supply lead in a gastight manner on the exterior of the discharge vessel, wherein the bushing is an electrically conductive ceramic composite consisting of a mixture of $LaB_6$ and at least one second material from the group $Al_2O_3$, $Dy_2Al_5O_{12}$, AlN, AlON and $Dy_2O_3$ is disclosed.

9 Claims, 6 Drawing Sheets

(56) References Cited

FOREIGN PATENT DOCUMENTS

| | | | |
|---|---|---|---|
| DE | 102007055399 | A1 | 5/2009 |
| HU | 215321 | B | 11/1998 |
| JP | H08148118 | | 6/1996 |
| JP | 2002231187 | | 8/2002 |
| WO | 2010069678 | A2 | 6/2010 |

OTHER PUBLICATIONS

Search Report issued in the corresponding Hungarian application No. P1300405, dated Sep. 25, 2013, 3 pages.

English language abstract of DE 102007055399 A1 dated May 28, 2009.

Office Action in the related Chinese application No. 201080069703.x issued on Jan. 19, 2015, 6 pages (for information purposes only).

* cited by examiner

CERAMIC BUSHING FOR A HIGH-PRESSURE DISCHARGE LAMP

RELATED APPLICATIONS

The present application is a national stage entry according to 35 U.S.C. §371 of PCT application No.: PCT/EP2010/065728 filed on Oct. 19, 2010.

TECHNICAL FIELD

Various embodiments relates to a ceramic bushing for a high-pressure discharge lamp.

BACKGROUND

WO 2010/069678 discloses a ceramic electrode which is fashioned as a layer and is fashioned from $LaB_6$ or $CeB_6$. Such a layer electrode is produced by means of dry pressing, an injection-molding process or multilayer technology.

SUMMARY

Various embodiments provide a ceramic bushing for a high-pressure discharge lamp which has a coefficient of thermal expansion well matched to a ceramic discharge vessel and thus improves the impermeability.

The novel ceramic bushing according to various embodiments is a pin similar to the known cermets. However, while the conventional cermets consist of a mixture Mo—$Al_2O_3$, now a mixture of $LaB_6$ and $Al_2O_3$ is used for adaptation to a ceramic discharge vessel, in particular composed of PCA. This mixture produces an electrically conductive bushing having sufficient current-carrying capacity.

According to the prior art, for the discharge vessel of a high-pressure discharge lamp, ceramic hollow bodies are produced e.g. by low-pressure injection into a corresponding mold. Two half-shells produced in this way are welded to one another in green form and then sintered in a gastight manner. The electrode systems, consisting of bushing and electrode, are fused with glass solder into the capillaries of the discharge vessel after the filling has been metered into the discharge volume. The bushing normally consists of a niobium pin, onto which an electrically conductive Mo—$Al_2O_3$ cermet (50/50% by volume) having a coefficient of thermal expansion of approximately $7.3*10^{-6}K^{-1}$ is welded. The electrodes, shaft and head, are produced from tungsten.

A ceramic composite based on $LaB_6$ is used as new electrode material. $LaB_6$ has a work function of 2.14 eV and an electrical resistance of 15 μohm-cm. The coefficient of thermal expansion $\alpha$ is $6.2*10^{-6}K^{-1}$. It is therefore less than the coefficient of expansion of pure PCA, here $\alpha=8.3*10^{-6}K^{-1}$. The most important properties of $LaB_6$ are compared with those of tungsten, see table 1.

TABLE 1

| Material | Tungsten | $LaB_6$ |
|---|---|---|
| Melting point | 3600° C. | 2528 K |
| Work function | 4.55 eV | 2.14 eV |
| Thermal conductivity | 170 W/mK | 47 W/mK |
| Coefficient of thermal expansion | $4.7 \times 10^{-6}$/K | $6.2 \times 10^{-6}$/K |

For bushings, with regard to a discharge vessel composed of PCA or the like, the difference in the coefficient of thermal expansion is somewhat too great, however. Therefore, $Al_2O_3$ or $Dy_2Al_5O_{12}$ is admixed in order to raise the coefficient of thermal expansion and adapt it to the PCA. This is designated hereinafter as an $LaB_6$ composite.

The production of the bushing or of an entire electrode system comprising bushing, shaft and head can either be effected by means of the injection-molding process, in which $LaB_6$ composite/wax mixtures or other polymers are injected into a cavity having the shape of a bushing or entire electrode system. However, production by means of multilayer technology is also possible. In this case, films composed of $LaB_6$ composite/binder mixtures are drawn and electrode systems of corresponding shape are stamped out. Binder removal and sintering of the electrode systems ensue in both processes. It has been found that the sintering behavior of pure $LaB_6$ (sintering temperature: 1900-2100° C.) is extremely sluggish and an undesirable residual porosity of up to 20% by volume remains.

In order to close the residual porosity and at the same time to raise the coefficient of thermal expansion to that of the ceramic discharge vessel, usually PCA, $Al_2O_3$ is added to the powder mixtures. The addition of $Al_2O_3$ to $LaB_6$ is between 5 and 50% by volume. This makes possible significantly lower sintering temperatures (1600-1800° C.) than in the case of pure $LaB_6$. Furthermore, a fully densified microstructure is produced which exhibits no interaction with the corrosive lamp fillings of high-pressure discharge lamps.

Alongside $Al_2O_3$ for adapting the coefficient of thermal expansion, it is also possible to use $Dy_2Al_5O_{12}$ (dysprosium aluminate) alone or in combination. It has a coefficient of thermal expansion of $8.5*10^{-6}K^{-1}$ and likewise exhibits no interactions or corrosive decomposition with the lamp fillings. $Al_2O_3$ and $Dy_2Al_5O_{12}$ can also be used simultaneously for the adaptation of the thermal expansion.

The ceramic pin thus produced may serve as either only bushing or component including bushing and shaft or complete electrode system including bushing, shaft and head of the electrode. The electrical contact-connection on the outside can take place by means of a small tube of niobium pressed on. Alternatively, the $LaB_6$ composite pins may be nickel-plated and then hard-soldered, as known per se.

Advantages here are in particular:

- drastic simplification of the electrode system;
- use of ceramic, electrically conductive materials having a low work function;
- reduction of the operating temperature of the electrode tip from 3200 K to 1800-2000 K;
- thermal conductivity of $LaB_6$ is significantly lower than that of tungsten; this results in a significantly reduced heat transfer into the lamp surroundings, in particular into the critical zones of the electrode bushing;
- adaptation of the coefficient of thermal expansion of the bushing to the ceramic discharge vessel;
- material of the bushing or of the entire electrode is directly compatible with material of the discharge vessel, which results in an improved linking between electrode and discharge vessel, in the sense of a better mechanical stability and a more compact design;
- longer lifetime (at least 20%, depending on the embodiment up to 100%), since a main cause of failure, the capillaries of the electrode bushings, are made more robust;
- higher energy efficiency, since the electrodes are operated at a lower temperature and thus have fewer thermal losses.

According to the prior art, ceramic hollow bodies, usually composed of $Al_2O_3$ (PCA), are used for the discharge vessel of a high-pressure discharge lamp. They are usually produced by low-pressure injection into a corresponding mold. Two half-shells thus produced, to which capillaries are attached, are welded to one another in green form and then sintered in a gastight manner. The electrode systems are fused into the capillaries by means of glass solder after a filling usually containing metal halides has been introduced.

Usually, the electrode heads are produced from metal having the highest possible melting point. Tungsten having an electron work function of 4.54 eV is suitable. The temperature at the electrode tip reaches approximately 3100 K during operation.

It is typical for the discharge vessel to be equipped with electrodes. One or two electrodes can be used.

Preferably, the head of the electrode has a substantially rounded, cylindrical or else tapering shape.

The work function of $LaB_6$, which is lower by approximately 2 eV relative to tungsten, leads to an experimentally determined decrease in temperature at the tip of the electrode by approximately 1300 K relative to tungsten, for which the typical value is 3100 K.

This leads to evaporation rates comparable to those for tungsten, but to significantly lower thermal losses on account of the lower thermal conductivity and the lower operating temperature, which is tantamount to higher efficiency. This in turn has the consequence that the energy input into the bushing is reduced.

As a result of the lower working temperature or operating temperature and the fact that $LaB_6$ has a significantly higher coefficient of thermal expansion than tungsten, which is considerably closer to that of $Al_2O_3$ (PCA has 8.3 $10^{-6}$/K), this affords the possibility of a significantly shorter structural length of the lamps because the length of the capillary may be reduced. A further positive effect associated therewith results in a reduced dead space volume.

This in turn leads to reduced color variation and a longer lifetime.

A construction entirely without a capillary dead space is also possible, which for the first time allows an unsaturated lamp filling with all the advantages thereof, such as e.g. the dimmability.

An additional factor is that a material such as $LaB_6$ is corrosion-resistant toward rare earth iodides as a constituent of the filling. As a result, the lifetime is increased further.

Overall, advantages therefore arise as a result of the lower operating temperature, reduced thermal losses, higher efficiency, saving of electrical energy, low color variation, higher reliability, high resistance to corrosion.

In particular, it is possible to use a filling which is free of mercury.

A bushing for a high-pressure discharge lamp, which is suitable for connecting an electrode in the interior of a ceramic discharge vessel to a supply lead in a gastight manner on the exterior of the discharge vessel, characterized in that the bushing is an electrically conductive ceramic composite consisting of a mixture of LaB6 and at least one second material from the group $Al_2O_3$, $Dy_2Al_5O_{12}$, AlN, AlON and $Dy_2O_3$, is disclosed.

In a further embodiment, the bushing is configured such that the bushing is a pin.

In a still further embodiment, the proportion of $LaB_6$ is between 95 and 30% by volume.

In a still further embodiment, the proportion of $LaB_6$ is between 80 and 50% by volume.

In a still further embodiment, the second material is $Al_2O_3$ or $Dy_2Al_5O_{12}$.

An electrode for a high-pressure discharge lamp, which is connected to a bushing is disclosed.

In a further embodiment, the electrode is configured such that the electrode and the bushing are produced integrally from the ceramic composite.

A high-pressure discharge lamp includes a bushing, wherein the discharge vessel is produced from ceramic material.

In a further embodiment, the high pressure discharge lamp is configured such that the discharge vessel is produced from PCA.

In a still further embodiment, the discharge vessel has a tubular end part in which a pin-like bushing is sealed either by means of glass solder or by means of direct sintering-in.

BRIEF DESCRIPTION OF THE DRAWINGS

The invention will be explained in greater detail below on the basis of an exemplary embodiment. In the figures.

DETAILED DESCRIPTION

The following detailed description refers to the accompanying drawings that show, by way of illustration, specific details and embodiments in which the invention may be practiced.

Figure 1:
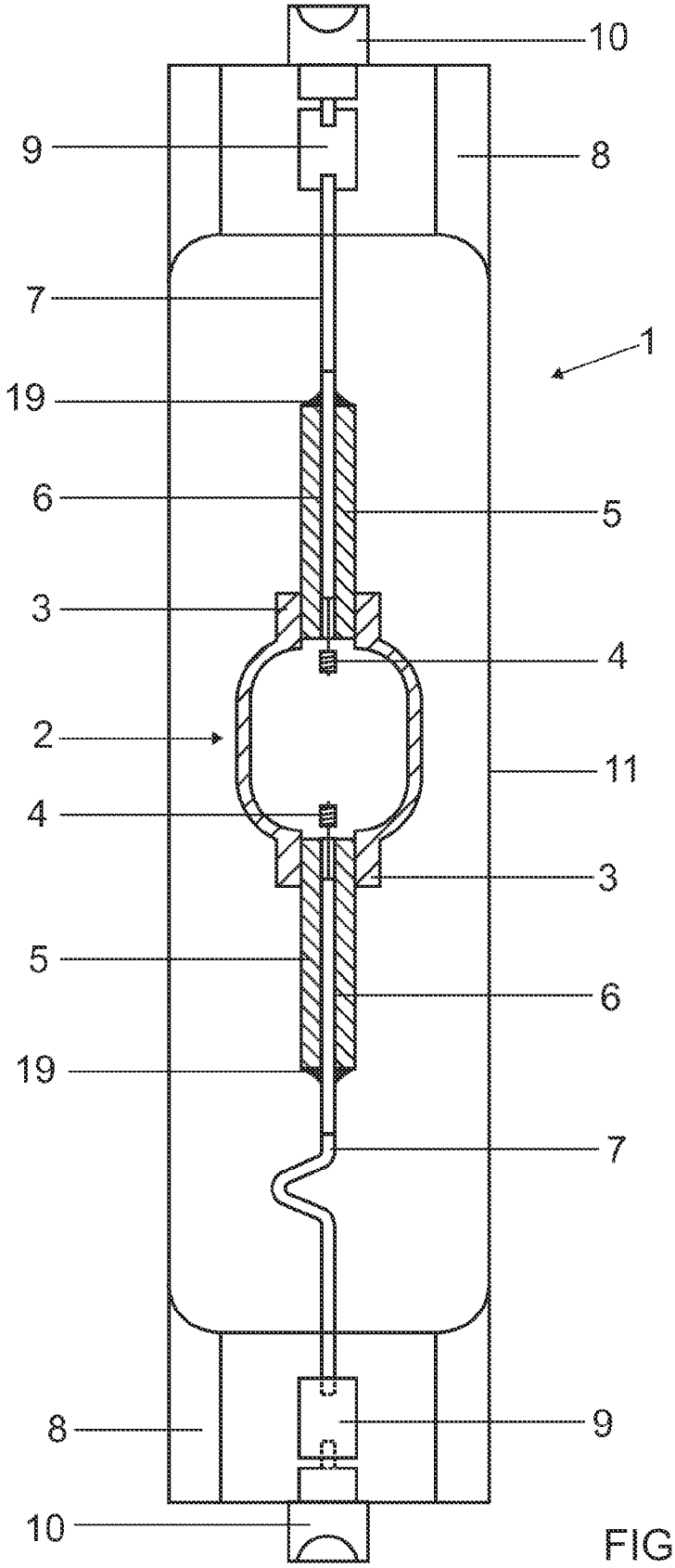
FIG. 1 schematically shows a metal halide lamp.

FIG. 1 shows an exemplary embodiment of a metal halide high-pressure discharge lamp 1. Said lamp has a ceramic discharge vessel 2 closed on two sides. Said vessel is elongated and has two ends 3 with seals. In the interior of the discharge vessel, two electrodes 4 are seated opposite one another. The seals are embodied as capillaries 5 in which a bushing 6 is sealed by means of glass solder 19. From the capillary 5 there projects in each case the end of the bushing 6, which on the discharge side is connected in a known manner to the assigned electrode 4. The latter is connected via a power supply lead 7 and a pinch 8 with film 9 to a base contact 10. The contact 10 is seated at the end of an outer bulb 11 surrounding the discharge vessel.

Figure 2:
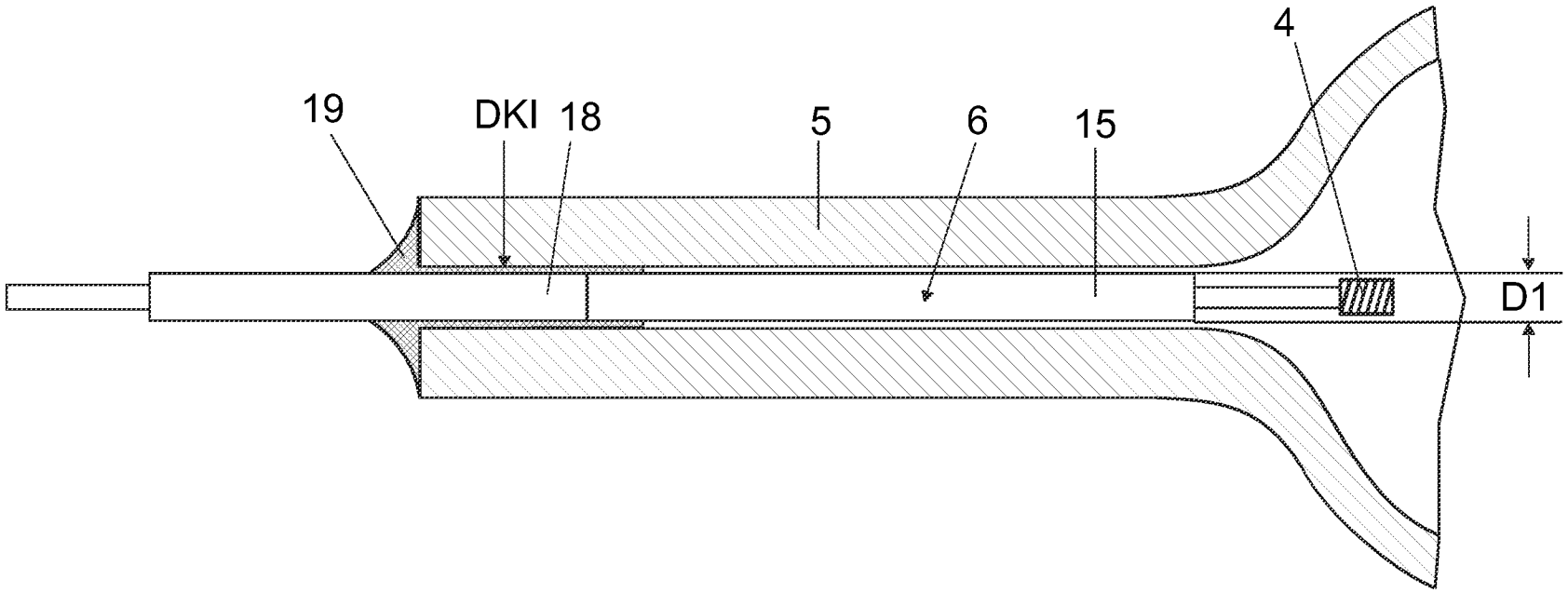
FIG. 2 shows a novel embodiment of the end region.

FIG. 2 shows an end region in detail for a 70 W lamp. The capillary 5 is comparatively short here (4 mm). The capillary has an internal diameter DKI of 1000 μm, chosen such that the electrode system just fits in. The bushing 6 is a ceramic composite pin 15 consisting of a mixture of $LaB_6$ and $Al_2O_3$. A niobium sleeve 18 is attached thereto on the outside.

The glass solder 19 is applied to the end of the capillary on the outside and extends inward approximately to an extent such that it fills the entire interspace between $LaB_6$ composite and capillary.

Alternatively, the ceramic and the composite pin can also be directly sintered together. This construction attains a thermal equilibrium very rapidly.

Figure 3:
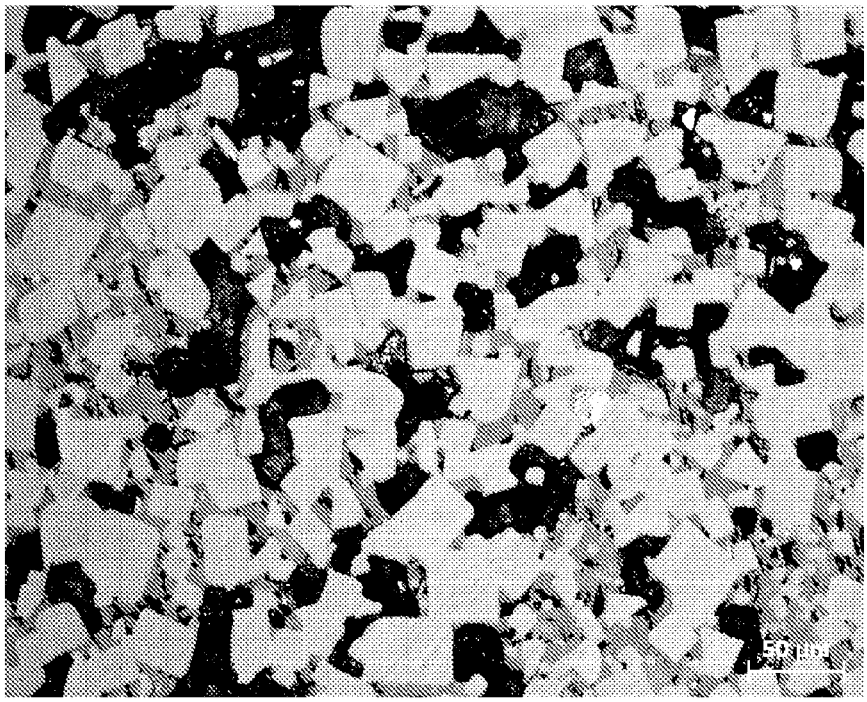
FIG. 3 shows the structure of a pure $LaB_6$ ceramic in accordance with the prior art.
Figure 4:
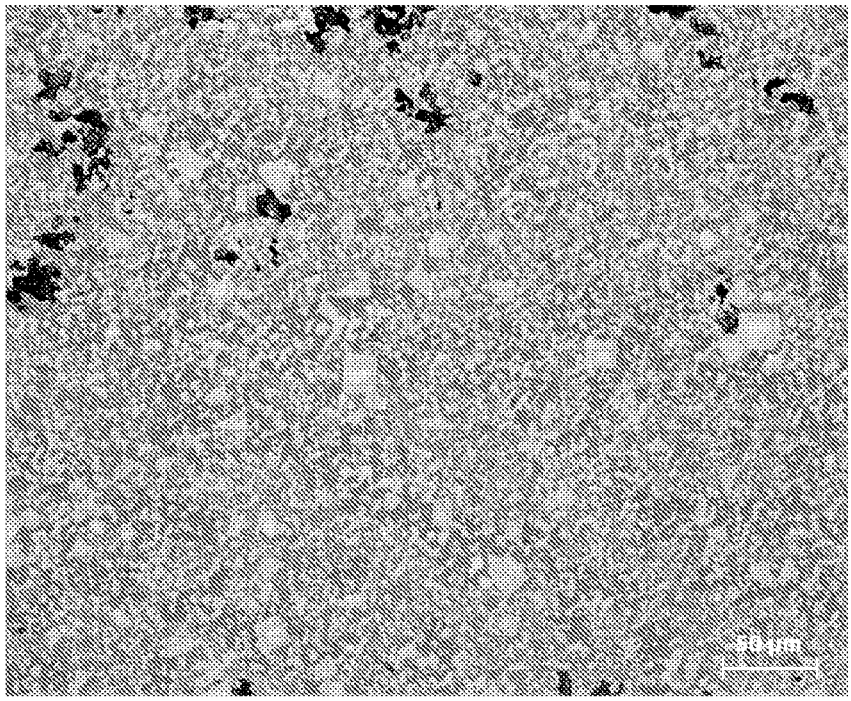
FIG. 4 shows the structure of a bushing ceramic according to the invention.

FIG. 3 shows the microstructure of a pure $LaB_6$ pin. The latter exhibits a very high degree of grain growth and has a high porosity. It has to be sintered at approximately 2000° C. and is therefore hardly useable as a bushing. By contrast, an $LaB_6$ composite, namely an $LaB_6$ mixture to which 20% by volume of $Al_2O_3$ was added, has a dense microstructure (FIG. 4) when the $LaB_6$ composite was sintered at approximately 1800° C. for approximately 60 min.

Figure 5:
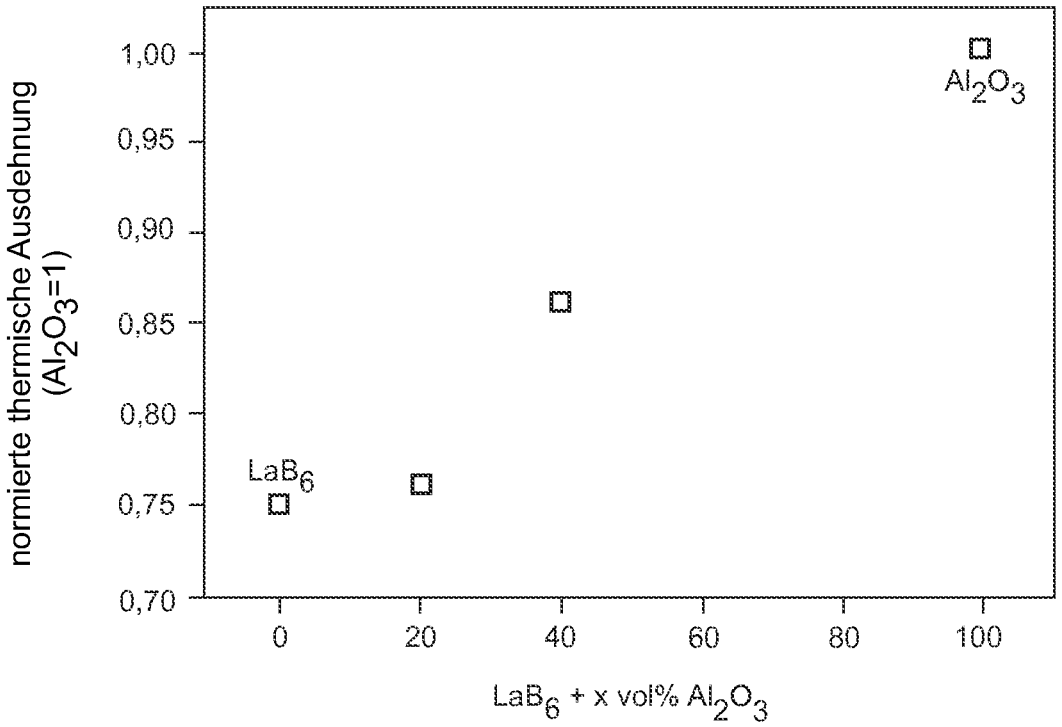
FIG. 5 shows a diagram of the normalized coefficient of thermal expansion for a mixture composed of $LaB_6$ and $Al_2O_3$.

FIG. 5 shows a diagram indicating the coefficient of thermal expansion, normalized to $Al_2O_3$, of a bushing comprising different proportions of $Al_2O_3$ as admixture with $LaB_6$. The higher the proportion of $Al_2O_3$, the more the coefficient of thermal expansion approaches that of PCA, that is to say polycrystalline $Al_2O_3$. However, for process engineering reasons and the requirement of sufficient electrical conductivity, it is not expedient to increase the proportion of $Al_2O_3$ above more than 50% by volume. $LaB_6$ and a plurality of $LaB_6$/$Al_2O_3$ mixtures are shown as an example. The coefficient of thermal expansion is illustrated in a manner normalized relative to PCA (PCA=1) there. It is found that, as a result of the addition of $Al_2O_3$, the coefficient of expansion of $LaB_6$ can be significantly increased and approximated to that of $Al_2O_3$.

Figure 6:
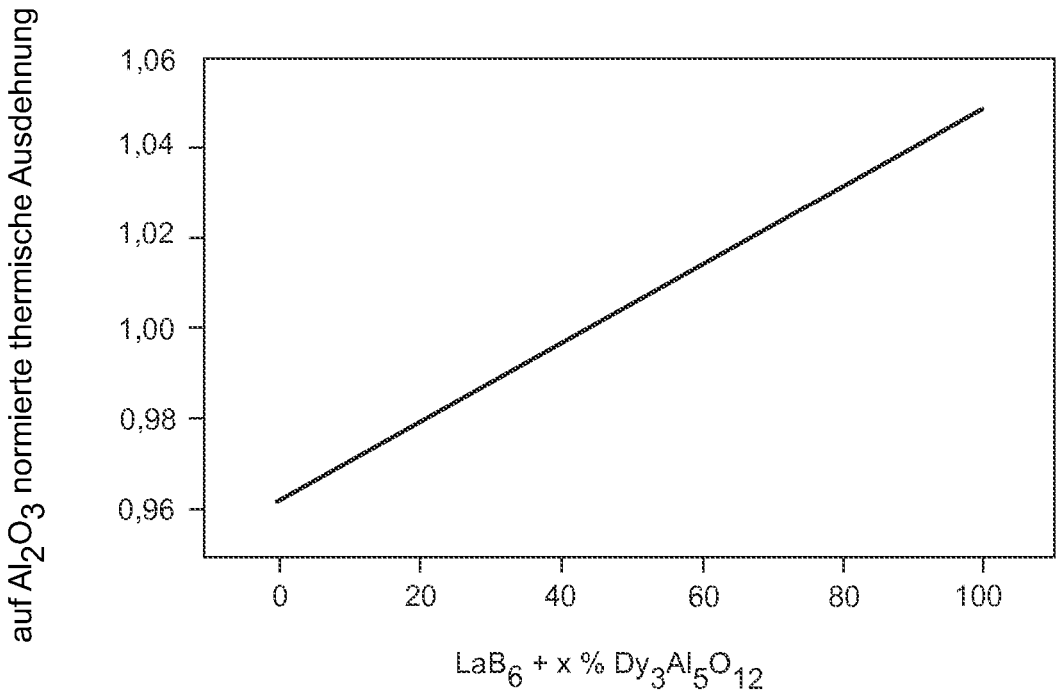
FIG. 6 shows a diagram of the normalized coefficient of thermal expansion for a mixture composed of $LaB_6$ and $Dy_2Al_5O_{12}$.

Alternatively, in accordance with FIG. 6, $Dy_2Al_5O_{12}$ can be added to the $LaB_6$ as admixture. Since $Dy_2Al_5O_{12}$ has a higher coefficient of thermal expansion than $Al_2O_3$, smaller proportions suffice to approach the coefficient of thermal expansion of $Al_2O_3$. It is even possible to exactly attain the coefficient of thermal expansion of $Al_2O_3$ if approximately 50% $LaB_6$ and 50% $Dy_2Al_5O_{12}$ are used. In this case of application, therefore, preference is given to a proportion of $LaB_6$ of 30 to 70%, preferably 40 to 60%.

Figure 7:
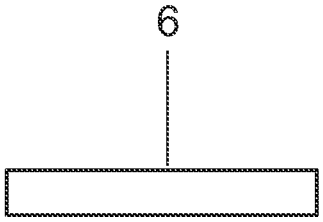
FIG. 7 shows a bushing composed of $LaB_6$ composite.

FIG. 7 shows a bushing produced as a pin composed of an $LaB_6$ composite. The proportion of conductive $LaB_6$ is approximately 70 to 50% and is therefore above the percolation limit. Here the proportion of $Al_2O_3$ can be chosen to be relatively high, preferably 30 to 50% by volume.

Figure 8:
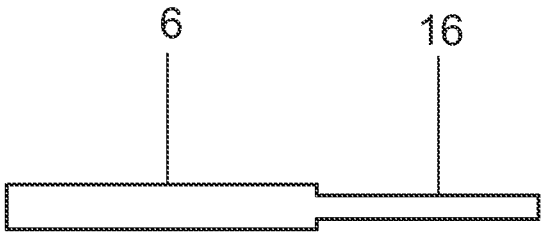
FIG. 8 shows a component for an electrode system composed of $LaB_6$ composite.

In accordance with FIG. 8, in principle, bushing 6 and shaft 16 of the electrode can be produced as one component integrally from $LaB_6$ composite. A head composed of W is then separately attached and mechanically connected, as known per se. In principle, however, it is preferred to keep the electrode as free of tungsten as possible.

Figure 9:
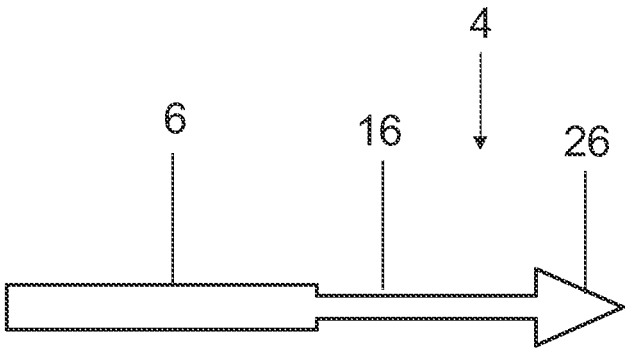
FIG. 9 shows an electrode system composed of $LaB_6$ composite.

Particularly preferably, in accordance with FIG. 9, the entire electrode system can be produced integrally from $LaB_6$ with $Al_2O_3$. Since then alongside bushing 6 and shaft 16 primarily the head 26 is exposed to very high temperatures, a relatively small proportion of $Al_2O_3$ of 5 to 20% by volume is advantageously chosen.

Figure 10:
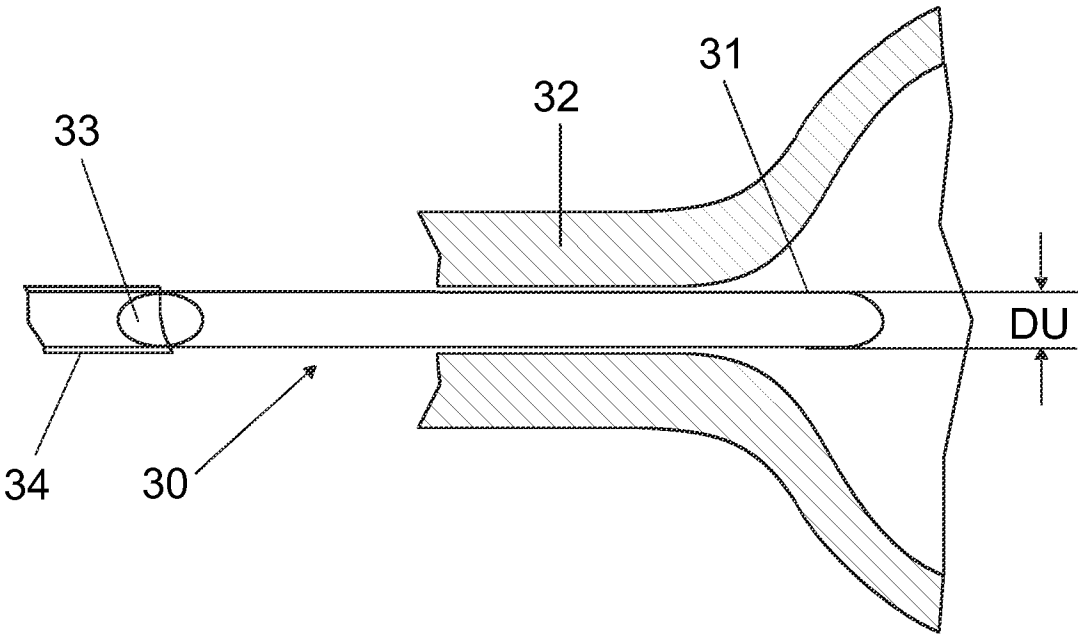
FIG. 10 shows a further exemplary embodiment of a novel end region.

What is particularly advantageous is the embodiment as a pin 30, which replaces an entire electrode system, having a constant diameter DU and a rounded head 31 in accordance with FIG. 10. The pin 30 serves simultaneously both as electrode bushing and as electrode itself. It is directly sintered into the capillary 32 at the end of the discharge vessel. In principle, it can also be sealed in the capillary by means of glass solder. The pin 30 has at the outer end a flattened portion 33, onto which a niobium sleeve 34 is pressed. This solution is distinguished by a particularly small structural height of the capillary because the pin 30 has good thermal loading capacity.

The bushing or electrode system presented here is particularly well suited to discharge vessels composed of $Al_2O_3$, specifically PCA. The novel bushing can also be used for discharge vessels composed of other materials such as, in particular, AlN, AlON or $Dy_2O_3$. The use of mixtures of $LaB_6$/AlN, $LaB_6$/AlON or $LaB_6$/$Dy_2O_3$ is recommended here. In particular, the proportion of conductive $LaB_6$ here should in each case be above the percolation limit.

The invention claimed is:

1. A bushing for a high-pressure discharge lamp, which is suitable for connecting an electrode in the interior of a ceramic discharge vessel to a supply lead in a gastight manner on the exterior of the discharge vessel, wherein the bushing is an electrically conductive ceramic composite consisting of a mixture of $LaB_6$ and at least one second material $Dy_2Al_5O_{12}$.

2. The bushing as claimed in claim 1, wherein the bushing is a pin.

3. The bushing as claimed in claim 1, wherein the proportion of $LaB_6$ is between 95 and 30% by volume.

4. The bushing as claimed in claim 3, wherein the proportion of $LaB_6$ is between 80 and 50% by volume.

5. An electrode for a high-pressure discharge lamp, which is connected to a bushing, which is suitable for connecting the electrode in the interior of a ceramic discharge vessel to a supply lead in a gastight manner on the exterior of the discharge vessel, wherein the bushing is an electrically conductive ceramic composite consisting of a mixture of $LaB_6$ and at least one second material $Dy_2Al_5O_{12}$.

6. The electrode as claimed in claim 5, wherein the electrode and the bushing are produced integrally from the ceramic composite.

7. A high-pressure discharge lamp having a bushing, which is suitable for connecting an electrode in the interior of a ceramic discharge vessel to a supply lead in a gastight manner on the exterior of the discharge vessel, wherein the bushing is an electrically conductive ceramic composite consisting of a mixture of $LaB_6$ and at least one second material $Dy_2Al_5O_{12}$ wherein the discharge vessel is produced from ceramic material.

8. The high-pressure discharge lamp as claimed in claim 7, wherein the discharge vessel is produced from PCA.

9. The high-pressure discharge lamp as claimed in claim 7, wherein the discharge vessel has a tubular end part in which a pin-like bushing is sealed either by means of glass solder or by means of direct sintering-in.

* * * * *

UNITED STATES PATENT AND TRADEMARK OFFICE

CERTIFICATE OF CORRECTION

PATENT NO. : 9,123,524 B2
APPLICATION NO. : 13/880067
DATED : September 1, 2015
INVENTOR(S) : Andreas Kloss et al.

It is certified that error appears in the above-identified patent and that said Letters Patent is hereby corrected as shown below:

Specification
Column 5, line 28: Please delete "$Al_2O_{3r}$" between the words "than" and "smaller", and write "$Al_2O_3$," in place thereof.

Signed and Sealed this
Eighth Day of March, 2016

Michelle K. Lee

Michelle K. Lee
*Director of the United States Patent and Trademark Office*